US008561710B2

(12) United States Patent
Nguyen

(10) Patent No.: US 8,561,710 B2
(45) Date of Patent: Oct. 22, 2013

(54) SEAL SYSTEM AND METHOD

(75) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 101 days.

(21) Appl. No.: 12/681,888

(22) PCT Filed: Sep. 17, 2008

(86) PCT No.: PCT/US2008/076714

§ 371 (c)(1),
(2), (4) Date: Apr. 6, 2010

(87) PCT Pub. No.: WO2009/055164

PCT Pub. Date: Apr. 30, 2009

(65) Prior Publication Data

US 2010/0206588 A1 Aug. 19, 2010

Related U.S. Application Data

(60) Provisional application No. 60/982,694, filed on Oct. 25, 2007.

(51) Int. Cl.
*E21B 33/12* (2006.01)

(52) U.S. Cl.
USPC ..... 166/387; 166/140; 166/196; 166/97.5; 277/312

(58) Field of Classification Search
USPC ..... 166/387, 140, 196, 182, 120, 121, 208, 166/123; 277/312, 650; 185/123.12
See application file for complete search history.

(56) References Cited

U.S. PATENT DOCUMENTS

| | | | | |
|---|---|---|---|---|
| 3,913,670 | A | 10/1975 | Ahlstone | |
| 3,924,679 | A | 12/1975 | Jansen, Jr. | |
| 3,933,202 | A | 1/1976 | Ahlstone | |
| 4,848,469 | A * | 7/1989 | Baugh et al. | 166/382 |
| 5,996,695 | A | 12/1999 | Koleilat et al. | |
| 6,260,850 | B1 | 7/2001 | Beall et al. | |
| 6,283,477 | B1 | 9/2001 | Beall et al. | |
| 6,969,070 | B2 | 11/2005 | Reimert et al. | |
| 7,111,688 | B2 | 9/2006 | Van Bilderbeek | |
| 7,128,143 | B2 | 10/2006 | Van Bilderbeek | |
| 7,137,453 | B2 | 11/2006 | Gustafson et al. | |

OTHER PUBLICATIONS

PCT International Search Report and Written Opinion for PCT/US2008/076714, dated Jun. 30, 2009.

* cited by examiner

*Primary Examiner* — Yong-Suk (Philip) Ro
(74) *Attorney, Agent, or Firm* — Fletcher Yoder, P.C.

(57) ABSTRACT

A tool for setting an annular seal, including an inner body, a first outer body coaxial with the longitudinal axis, and a second outer body coaxial with the longitudinal axis, wherein the second outer body is coupled to the first outer body. The inner body is configured to rotate about a longitudinal axis of the tool and is configure to bias a retaining ring, the first outer body is configured to couple to a potion of the mineral extraction system, and the second outer body is configured to move along the longitudinal axis to bias the annular seal.

20 Claims, 7 Drawing Sheets

SEAL SYSTEM AND METHOD

CROSS-REFERENCE TO RELATED APPLICATIONS

This application claims priority to and benefit of PCT Patent Application No. PCT/US2008/076714, entitled "Seal System and Method," filed Sep. 17, 2008, which is herein incorporated by reference in its entirety, and which claims priority to and benefit of U.S. Provisional Patent Application No. 60/982,694, entitled "Seal System and Method", filed on Oct. 25, 2007, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are employed to access and extract the resource. These systems can be located onshore or offshore depending on the location of a desired resource. Further, such systems generally include a wellhead assembly that is used to extract the resource. These wellhead assemblies generally include a wide variety of components and/or conduits, such as various control lines, casings, valves, and the like, that are conducive to drilling and/or extraction operations.

In drilling and extraction operations, various components and tools, in addition to and including wellheads, are employed to provide for drilling, completion, and the production of a mineral resource. During drilling and production (e.g., extraction), seals may be employed to provide a fluid seal that regulates pressures and/or to seal off fluid flow. For instance, a wellhead system often includes a tubing hanger or casing hanger that is disposed within the wellhead assembly and is configured to secure tubing and casing suspended in the well bore. The hanger generally provides a path for hydraulic control fluid, chemical injections, or the like to be passed through the wellhead and into the well bore. The wellhead system typically includes an annular seal that is compressed between a body of the hanger and a surrounding component of the wellhead (e.g., a tubing spool) to seal off the annular region between the two. The annular seal generally blocks pressures of the well bore from manifesting through the wellhead, and may enable the wellhead system to regulate the pressure within the annular region.

Typically, the annular seal is provided separate from the hanger, and is installed after the hanger has been landed in the wellhead assembly. In other words, the hanger is run down to the wellhead, followed by the installation of the annular seal. Installation of the annular seal generally includes procedures such as setting and locking the annular seal (e.g., compressing the annular seal such that is does not become dislodged). Installation of the seal may include the use of several tools and a sequence of procedures to set and lock the seal. For example, in a subsea application, the annular seal may be run from an offshore vessel (e.g., a platform) to the wellhead via a seal running tool coupled to a drill stem. After the seal running tool is retrieved, a second tool may be run to the wellhead to engage the seal. After the second tool is retrieved, a third tool may be run down to preload the seal. The third tool may then be retrieved to the offshore vessel. Later, a fourth tool may be used to retrieve the seal (e.g., at a later time—when service is needed). Unfortunately, each of the sequential running procedures may require a significant amount of time and cost. For example, each run of a tool may take several hours, which can translate into a significant cost when operating a mineral extraction system. Further, the use of multiple tools may introduce increased complexity and cost.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
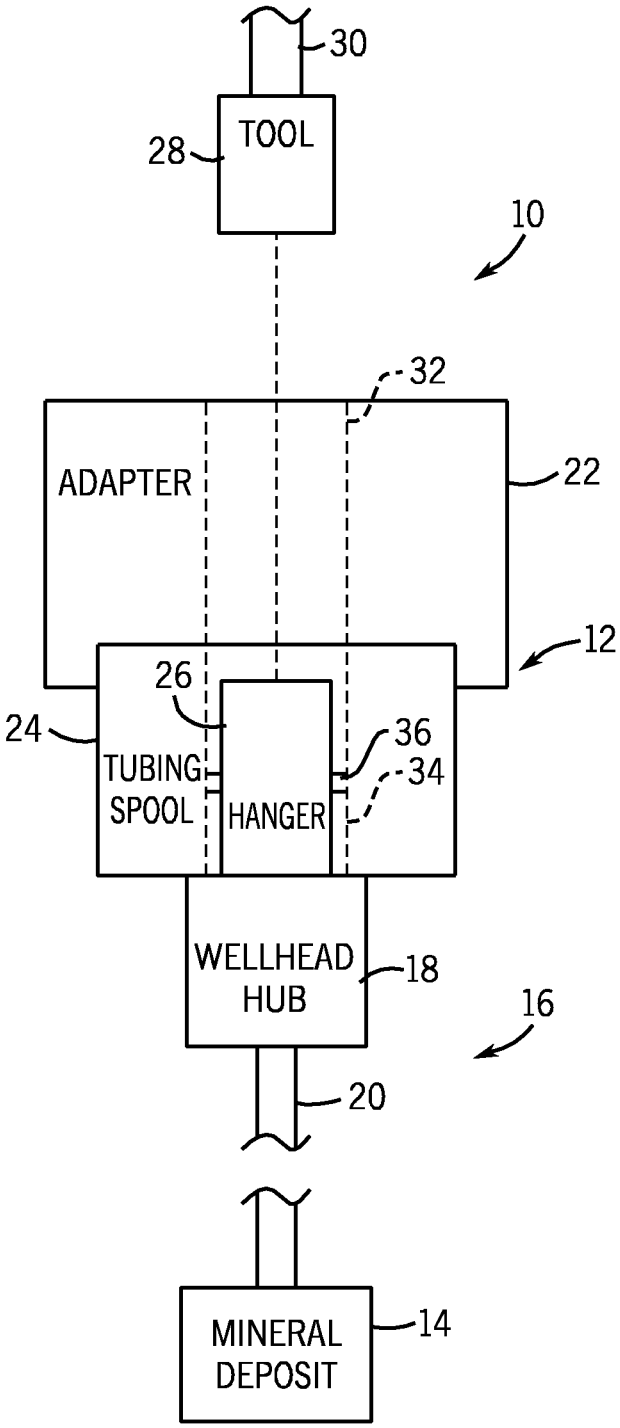
FIG. 1 illustrates a mineral extraction system in accordance with an embodiment of the present technique.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain exemplary embodiments of the present technique include a system and method that addresses one or more of the above-mentioned inadequacies of conventional sealing systems and methods. As explained in greater detail below, the disclosed embodiments include a sealing system and method that seats (e.g., compresses) and locks (e.g., preloads) a metal annular seal. In one embodiment, a retaining ring is rotated into a first position and may apply a first axial load on the seal, a second axial load is applied to the seal to compress the seal and relieve the first axial load if is exists (e.g., seal compression reduces the first load and friction at interfaces creating the first load), the retaining ring is rotated into a locked position, the second axial load reduced, and the seal is retained in place by the retaining ring that is now in the locked position. In certain embodiments, an annular seal setting tool is provided. In some embodiments, the seal setting tool can run the retaining ring and the seal to a wellhead, and can be used to set and seat the annular seal. In one embodiment, the annular seal setting tool includes an inner body, a first outer body, and a second outer body. Embodiments of operating the setting tool include rotating the retaining ring via rotation of the inner body, affixing the first outer body relative to the wellhead and the seal, and applying the second axial load to the seal via the second outer body. Accordingly, the embodiments discussed below enable rotation of the retaining ring to a first position, and enable the retaining ring to be rotated into the locked position with minimal torque because the second axial load compresses the seal and reduces friction at the interface of the retaining ring and the seal. The reduced friction also prevents or at least substantially reduces the possibility of the seal rotating with the retaining ring. Thus, the seal and the sealing surface may be less likely to undergo wear and damage associated with rotation.

FIG. 1 is a block diagram that illustrates a mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20.

The wellhead hub 18 generally includes a large diameter hub that is disposed at the termination of the well bore 20. The wellhead hub 18 provides for the connection of the wellhead 12 to the well 16. For example, in the illustrated system 10, the wellhead 12 is disposed on top of the wellhead hub 18 and includes a connector that is coupled to a complementary connector of the wellhead hub 18. In one embodiment, the wellhead hub 18 includes a DWHC (Deep Water High Capacity) hub manufactured by Cameron, headquartered in Houston, Tex., and the wellhead 12 includes a complementary collet connector (e.g., a DWHC connector), also manufactured by Cameron.

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, and provide for the injection of chemicals into the well bore 20 (down-hole). In the illustrated embodiment, the wellhead 12 includes an adapter (e.g., a drilling adapter) 22, a tubing spool 24, and a hanger 26 (e.g., a tubing hanger or a casing hanger). During completion of the mineral extraction system 10, the adapter 22 is typically replaced by what is colloquially referred to as a christmas tree (hereinafter, a tree). In extraction operations, the christmas tree provides various fluid paths valves and controls that enable further routing and regulation of the produced fluids and minerals.

The adapter 22 generally includes an intermediate device that enables the connection of one or more devices. In the illustrated embodiment, the adapter 22 includes a drilling adapter coupled to the tubing spool 24. During down-hole procedures, installations, completions, a workover procedure, or the like, the adapter 22 is set atop the tubing spool 24 to enable tools, casing, or other devices to be retrieved or installed down-hole. For example, where the size of a tubing spool bore 34 is not equivalent to the diameter of a tool 28 or a drill string 30, the adapter 22 may include an adapter bore 32 that compensates for the difference. The adapter 22 is used also to retain components in the tubing spool 24. For example, during an operation where the tubing spool 24 is in place, and drill pipe, casing, or tubing are being passed through the tubing spool bore 34, a bushing (e.g., a sleeve) may be installed to protect damage to the internal surfaces of the tubing spool bore 34. Coupling the adapter 22 to the tubing spool 24 can block the bushing from backing out of the tubing spool bore 34. In another embodiment, the adapter 22 includes a blow-out-preventer (BOP) adapter that provides an intermediate connection between the tubing spool 24 and a blow-out-preventer (BOP) stack.

The tubing spool 24 provides a base for the wellhead 12 and/or an intermediate connection between the wellhead hub 18 and the adapter 22 or the christmas tree. Typically, the tubing spool 24 is one of many components in a modular subsea mineral extraction system 10 that is run down from an offshore vessel. The tubing spool 24 includes the tubing spool bore 34. The tubing spool bore 34 connects (e.g., enables fluid communication between) the adapter bore 32 and the well 16. Thus, the tubing spool bore 34 may provide access to the well bore 20 for various completion and worker procedures. For example, components may be run down to the wellhead 12 and disposed in the tubing spool bore 34 to seal-off the well bore 20, to inject chemicals down-hole, to suspend tools down-hole, to retrieve tools down-hole, and the like.

The system 10 can also include other devices that are coupled to the wellhead 12, and devices that are used to assemble and control various components of the wellhead 12. For example, in the illustrated embodiment, the system 10 includes the tool 28 suspended from the drill string 30. In certain embodiments, the tool 28 includes a running tool that is lowered (e.g., run) from an offshore vessel to the well 16 and/or the wellhead 12. In other embodiments, such as surface systems, the tool 28 may include a device suspended over and/or lowered into the wellhead 12 via a crane or other supporting device.

As will be appreciated, mineral extractions systems 10 are often exposed to extreme conditions. For example, during drilling and production of a well 16, the well bore 20 may have internal pressures that exceed 10,000 pounds per square inch (PSI). Accordingly, mineral extraction systems 10 employ various mechanisms, such as seals and valves, to control and regulate the well 16. Specifically, seals are employed to seal the annular regions between one or more concentric components. The concentric components may be referred to tubulars, and may include various cylindrically shaped components and connectors of the mineral extraction system 10, such as the hanger 26 and/or the wellhead 12. For instance, the hanger 26 (e.g., tubing hanger or casing hanger) is typically disposed within the wellhead 12 to secure tubing and casing suspended in the well bore 20, and provides a path for hydraulic control fluid, chemical injections, and the like to be passed down-hole. Unfortunately, pressures may be experienced in the annular region between the hanger 26 and the surrounding bore (e.g., tubing spool bore 34). An annular seal 36 is often seated and locked in annular regions, such as between the hanger 26 and the tubing hanger bore 34, to control pressures in the annular region. For example, the annular seal 36 (hereafter referred to as "the seal 36") may be compressed between the hanger 26 and a wall of the tubing hanger bore 34 to block pressures in the well 16 from manifesting through the wellhead 12. Such annular seals 36 are used throughout mineral extraction systems 10 to provide a seal between concentric members.

In the context of the hanger 26 of the mineral extraction system 10, the seal 36 is typically provided separately from the hanger 26 and is installed after the hanger 26 has been landed in the wellhead 12 (e.g., the tubing spool bore 34). In other words, the hanger 26 may be run down and installed into the subsea wellhead 12, followed by the installation of the seal 36. Installation of the seal 36 typically includes seating and locking the seal 36 (e.g., compressing the seal such that is does not become dislodged). Accordingly, installation of the seal 36 may include the use of several tools 28 and corresponding procedures to seat and lock the seal 36. For example, the seal 36 may be run from a drilling vessel to the wellhead 12 via the running tool 28, the running tool 28 may be retrieved, a second tool 28 may be run to the wellhead 12 to seat the seal 36, the second tool 28 may be retrieved, a third tool 28 may be run down to lock the seal 36, and the third 28 tool may be retrieved. Unfortunately, each tool and running procedure may involve a significant amount of time and cost. The following embodiments discuss a system and method that provides for running, seating, and locking the seal 36 in the mineral extraction system 10. For example, the disclosed embodiments may reduce the number of tools and procedures, thereby reducing cost and time associated with setup, service, etc.

Figure 2:
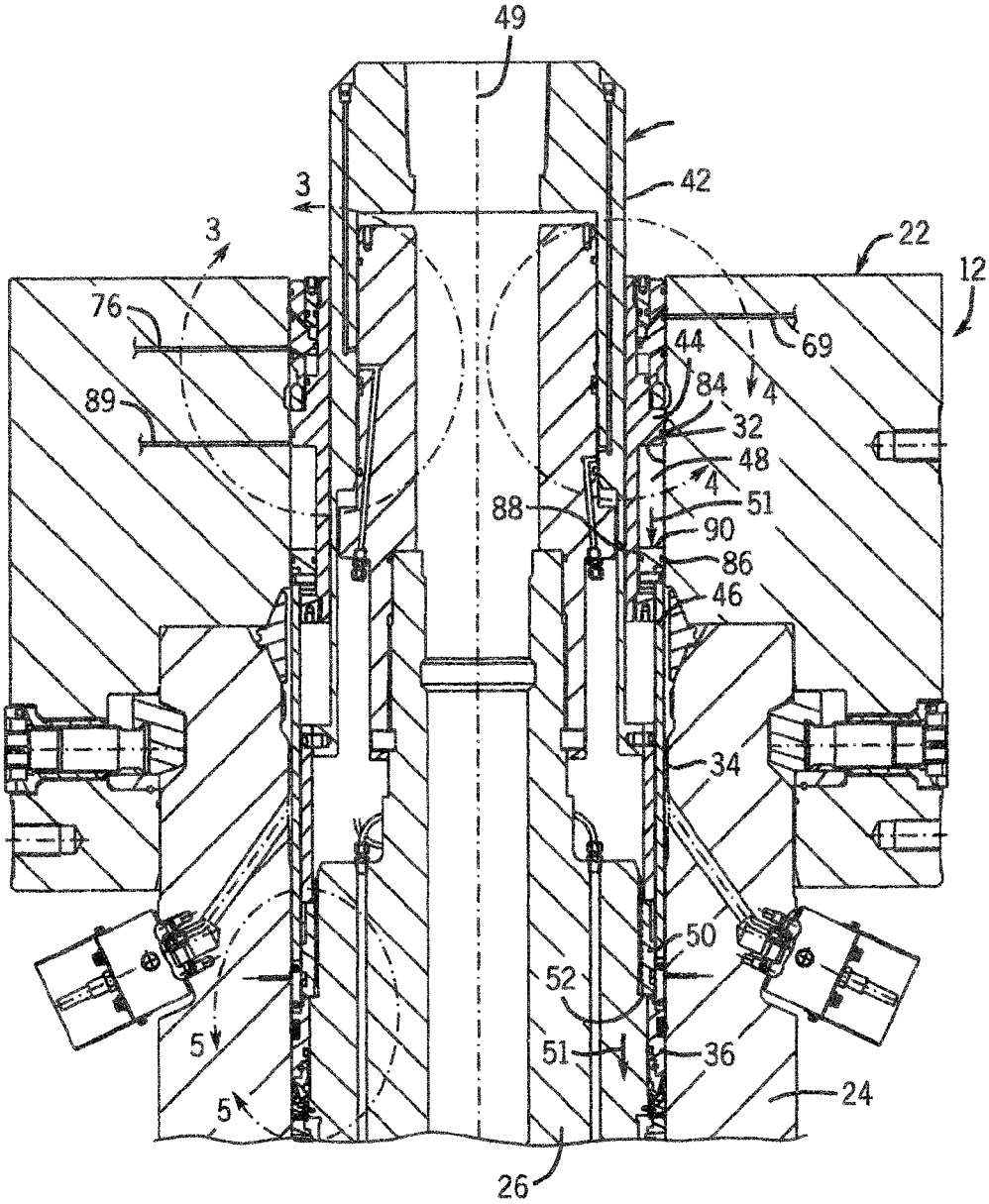
FIG. 2 illustrates an embodiment of an annular seal setting tool, an annular seal, and a tubing hanger, disposed in a wellhead of the mineral extraction system of FIG. 1.

FIG. 2 illustrates a cross section of an exemplary embodiment of a hydraulic setting tool 40 (herein after referred to as the setting tool 40). In the embodiment, the setting tool 40 has been lowered into the wellhead 12 via the adapter bore 32. The hydraulic setting tool 40 is disposed in an annular region between the hanger 26 and the inner diameters of the adapter bore 32 and the tubing spool bore 34.

The setting tool 40 includes various components that are conducive to seating and locking the seal 36. For example, in the illustrated embodiment, the setting tool 40 includes an inner body 42, a first outer body 44, and a second outer body 46. When disposed in the annular region, the first outer body 42 and the second outer body are arranged such that a load cavity 48 is formed. In operation, the inner body 42 is employed to engage and rotate a retaining ring 50, and thread the retaining ring 50 onto the hanger 26. The inner body 42 is rotated about a longitudinal axis 49 of the inner body 42, for example. Rotating the retaining ring 50 axially advances the seal 36 into a first position between the tubing spool 24 and the hanger 26. In one embodiment, the first position includes the retaining ring 50 contacting the seal 36 and generating a first axial load on the seal 36 in a first direction (e.g., arrows 51). The first position of the retaining ring 50 may not include a portion of the retaining ring 50 contacting a shoulder 52 of the hanger 26.

The second outer body 46 is axially advanced in the direction of the seal 36 (e.g., in the direction arrows 51) such that a lower end of the second outer body 46 contacts the seal 36. For example, the first outer body 44 may be fixed relative to the adapter 22, the tubing spool 24 and the hanger 26, and the cavity 48 may be pressurized with a hydraulic fluid. Continuing to pressurize the load cavity 48 provides a second axial load on the second outer body 46 in the direction of the seal 36 (e.g., a first direction). The second axial load may be maintained or increased to urge the seal 36 into the seated and/or locked position. The second load acting on the seal 36 in the first direction may relieve/reduce the first axial load, it if exists, at the interface of the retaining ring 50 and the seal 36. The seal 36 may be axially compressed such that the first axial load at the interface of the retaining ring 50 and the seal 36 is reduced to about zero pounds. In other words, the second axial load may compress the seal 36 such that the seal 36 is no longer compressed against the retaining ring 50, and/or a gap is formed between the seal 36 and the retaining ring 50.

Applying the second axial load on the seal 36 may reduce the resistance to rotation (e.g., friction) that exists at the interface between the retaining ring 50 and the seal 36. Accordingly, the second axial load reduces the torque to rotate the retaining ring 50. For example, when the is first axial force is not acting on the retaining ring 50, rotating the retaining ring 50 may be achieved with virtually no torque or a minimal torque. The reduced friction may also prevent or reduce the possibility of transferring torque from the retaining ring 50 to the seal 36.

With the second axial load being applied and the absence of the first axial load acting on the retaining ring 50, the inner body 42 is rotated to, again, thread the retaining ring 50 toward the seal 36. The retaining ring 50 is rotated and threaded until it is in a locked position (e.g., a second position to maintain the seal 36 in the seated and locked position when the second axial force is removed). The locked position may include the retaining ring 50 engaging the seal 36, or being disposed proximate the seal 36.

With the retaining ring 50 in the locked position, the second axial force is reduced. In other words, the hydraulic pressure in the cavity 48 is reduced or eliminated to remove the second axial load from the seal 36 and enable the seal 36 to expand or at least exert a third force in the direction of the retaining ring 50 (e.g., opposite from the axial direction of arrow 51). In other words, the resilient nature of the seal 36 may cause the seal 36 to expand axially into contact with the retaining ring 50. The expansion of the seal 36 is limited by the retaining ring 50. Accordingly, as the second axial load is reduced, the seal 36 is retained in the locked position by the retaining ring 50. The retaining ring 50 provides the third axial load on the seal 36 and maintains the seal 36 in the seated and locked position.

With the seal 36 seated and locked, the hydraulic setting tool 40 is removed from the wellhead 12 via the adapter bore 32. The retaining ring 50 remains threaded onto the hanger 26, and retains the seal 36 in the seated and locked position. Accordingly, the setting tool 40 enables setting of the retaining ring 50 at an initial position, loading of the seal 36, manipulating the retaining ring 50 to the locked position, and removing the loading on the seal 36 (e.g., remove compression) such that the seal 36 is retained by the retaining ring 50 in the locked position.

Figure 3:
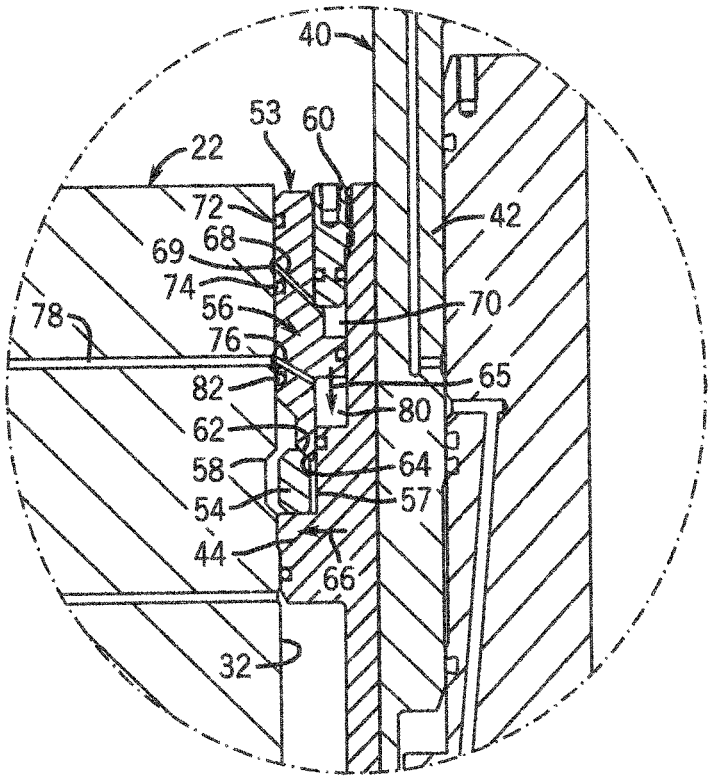
FIG. 3 illustrates a detailed view of the area 3-3 of FIG. 2.

The following is a detailed discussion of the previously discussed system and method. Turning now to FIG. 3, illustrated is a detail of a section illustrated in FIG. 2. As depicted, the setting tool 40 includes a locking mechanism 53 that couples the setting tool 40 to the adapter 22. The locking mechanism 53 includes a lock ring 54 and a locking sleeve 56, wherein both are disposed around an upper recess 57 of the first outer body 44, and retained by a retainer 60 that is threaded onto a top end of the first outer body 44.

The lock ring 54 includes a C-ring that is disposed about the outer diameter of the first outer body 44. In another embodiment, the lock ring 54 may include a series of lockingdogs, or a similar locking mechanism, that is disposed about the upper recess 57. The outer diameter of the lock ring 54 includes a profile that is complementary to a locking groove 58 that is disposed about the internal diameter of the adapter bore 32. As illustrated in FIG. 3, the lock ring 54 is biased inward such that the lock ring 54 can be passed into the adapter bore 32 with no or minimal contact between the lock ring 54 and the adapter 22. For example, when the setting tool 40 is lowered into the wellhead 12, the lock ring 54 may not contact the adapter bore 32.

Figure 4:
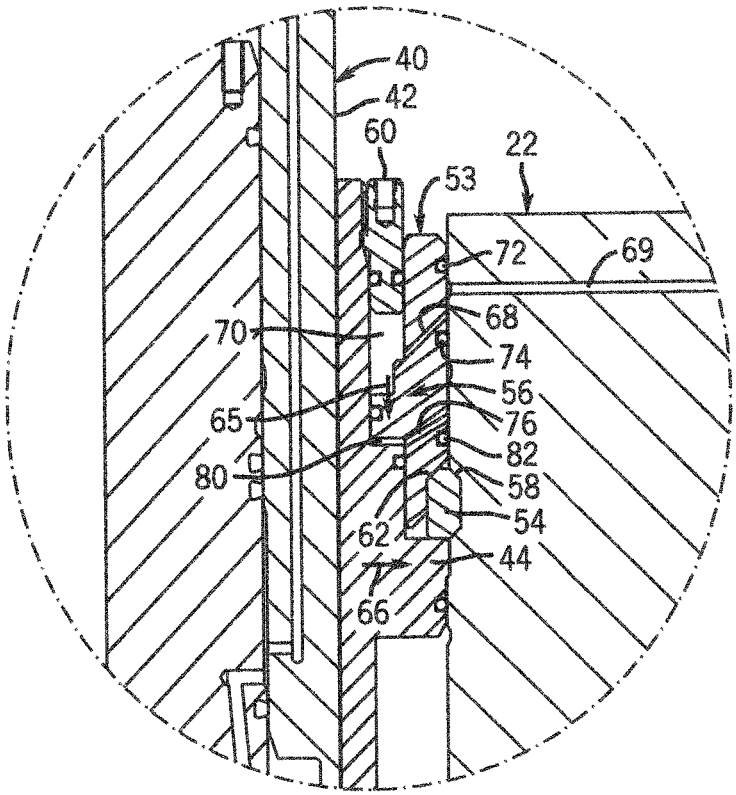
FIG. 4 illustrates a detailed view of the area 4-4 of FIG. 2 in a locked position.

The locking sleeve 56 includes a body having a profile that is conducive to urging the lock ring 54 into the locking groove 58. For example, the body of the locking sleeve 56 includes a chamfer 62 that engages a complementary chamfer 64 of the lock ring 54. Accordingly, advancing the locking sleeve 56 into contact with the lock ring 54 (e.g., in the direction of arrow 65) engages the lock ring 54 and causes the lock ring 54 to expand outward in a radial direction (e.g., in the direction of arrow 66). In an expanded position, the lock ring 54 engages the locking groove 58. FIG. 4 illustrates a portion (4-4) of the system of FIG. 2 that includes the locking sleeve 56 in a locked position, and the lock ring 54 engaged with the locking groove 58.

Referring now to FIGS. 3-4, the force to advance the locking sleeve 56 toward the lock ring 54 is provided via hydraulic fluid that is delivered from at least one port disposed in the adapter 22. For example, the locking sleeve 56 includes a lock port 68 that is in fluid communication with a lock port 69 of the adapter 22 and a locking cavity 70. The lock port 69 of the adapter 22 may include one or more ports that route hydraulic fluid through the adapter 22 and to the lock port 68. In the illustrated embodiment, the locking sleeve 56 includes a first seal 72 and a second seal 74, wherein the seals 72 and 74 are located about the external diameter of the locking sleeve 56 and on either side of the lock port 68. The first seal 72 and the second seal 74 enable fluid that is passed though the lock port 69 of the adapter 22 to be directed into the lock port 68 of the locking sleeve 56. Fluid that is directed into the lock port 68 is routed into the cavity 70. In other words, hydraulic fluid can be routed into the cavity 70 via the lock port 69 of the adapter 22 and the lock port 68 of the locking sleeve 56.

The locking cavity 70 includes an annular region that is formed between the locking sleeve 56, the first outer body 44, and the retainer 60. The pressure of a hydraulic fluid injected into the locking cavity 70 generates an axial force on the locking sleeve 56 in the direction of the arrow 65. Increasing the pressure of the hydraulic fluid in the cavity 70 causes the locking sleeve 56 to move axially from the unlocked position (see FIG. 3) to a locked position (see FIG. 4). The lock ring 54 does not engage the locking groove 56 in the unlocked position, whereas the lock ring 54 engages the locking groove 56 in the locked position. In the locked position, the lock ring 54 retains the setting tool 40 in the wellhead 12. In other words, in the locked position, the lock ring 54 extends radially into the groove 58 to block the setting tool 40 from axially backing out of the adapter bore 32 when the second axial load is applied to urge the seal 36 into the seated and locked position, as discussed previously.

To unlock the lock ring 54, the locking sleeve 56 is returned to the unlocked position. In other words, the locking sleeve 56 is moved axially in a direction opposite from that of arrow 65 to enable the lock ring 54 to disengage the locking groove 56. In the illustrated embodiment, the force to advance the locking sleeve 56 to the unlocked position is provided via hydraulic fluid that is delivered from at least one port disposed in the adapter 22. For example, the locking sleeve 56 includes an unlock port 76 that is in fluid communication with an unlock port 78 of the adapter 22 and an unlock cavity 80. The unlock port 78 of the adapter 22 may include one or more ports that route hydraulic fluid through the adapter 22 and to the unlock port 76 of the locking sleeve 56. In the illustrated embodiment, the locking sleeve 56 also includes the second seal 74 and a third seal 82, wherein the seals 74 and 82 are located on an external diameter of the locking sleeve 56, and are located on either side of the unlock port 76 of the locking sleeve 56. The second seal 74 and the third seal 82 enable hydraulic fluid that is passed though the unlock port 78 of the adapter 22 to be directed into the unlock port 76 of the locking sleeve 56. Fluid that is directed into the unlock port 76 of the locking sleeve 56 is routed into the unlock cavity 80. In other words, hydraulic fluid is routed into the unlock cavity 80 via the unlock port 78 of the adapter 22 and the unlock port 76 of the locking sleeve 56.

The unlock cavity 80 includes an annular region that is formed between the locking sleeve 56 and the first outer body 44. The pressure of hydraulic fluid injected into the unlock cavity 80 generates an axial force on the locking sleeve 56 in a direction opposite from arrow 65. Accordingly, increasing the pressure of the hydraulic fluid in the unlock cavity 80 causes the locking sleeve 56 to move axially from the locked position (see FIG. 4) to the unlocked position (see FIG. 3). In the unlocked position, the setting tool 40 may be extracted from the wellhead 12. In other words, in the unlocked position, the lock ring 54 does not extend radially into the groove 58 and, thus, does not retain the setting tool 40 in the adapter bore 32. Accordingly, the lock ring 54 may remain in the unlocked position during installation and removal of the setting tool 40.

Returning now to FIG. 2, the load cavity 48 is formed between the first outer body 44, the second outer body 46, and the inner diameter of the adapter bore 32. A fourth seal 84 is disposed between the first outer body 44 and the adapter bore 32 to provide a fluid seal at one end of the load cavity 48. A fifth seal 86 is disposed between the second outer body 46 and the inner diameter of the adapter bore 32 to provide a fluid seal at a second end of the load cavity 48. Further, a sixth seal 88 is disposed between the first outer body 44 and the second outer body 46 to provide a fluid seal at the second end of the load cavity 48.

To generate the second axial load applied to the seal 36, as discussed previously, hydraulic fluid is injected into the loading cavity 48 to generate a force in the direction of the arrow 51. In other words, increasing hydraulic pressure in the loading cavity 48 increases the pressure and resulting force (e.g., the second axial force) acting on a top face 90 of the second outer body 46. The second axial force may cause the second outer body 46 to move axially in the direction of arrow 51, and may be transmitted to the seal 36 when the seal 36 is engaged by the second outer body 46.

In the illustrated embodiment, the hydraulic fluid is routed to the loading cavity 48 via the at least one port disposed in the adapter 22. For example, the adapter 22 includes a loading port 89 that is in fluid communication with the loading cavity 48. The loading port 89 of the adapter 22 may include one or more ports that route hydraulic fluid through the adapter 22 to a portion of the adapter bore 22 that forms at least a portion of the loading cavity 48. Accordingly, hydraulic fluid is injected into the loading cavity 48 via the loading port 89 of the adapter to generate an axial force on the top face 90 of the second outer body 46.

Figure 5:
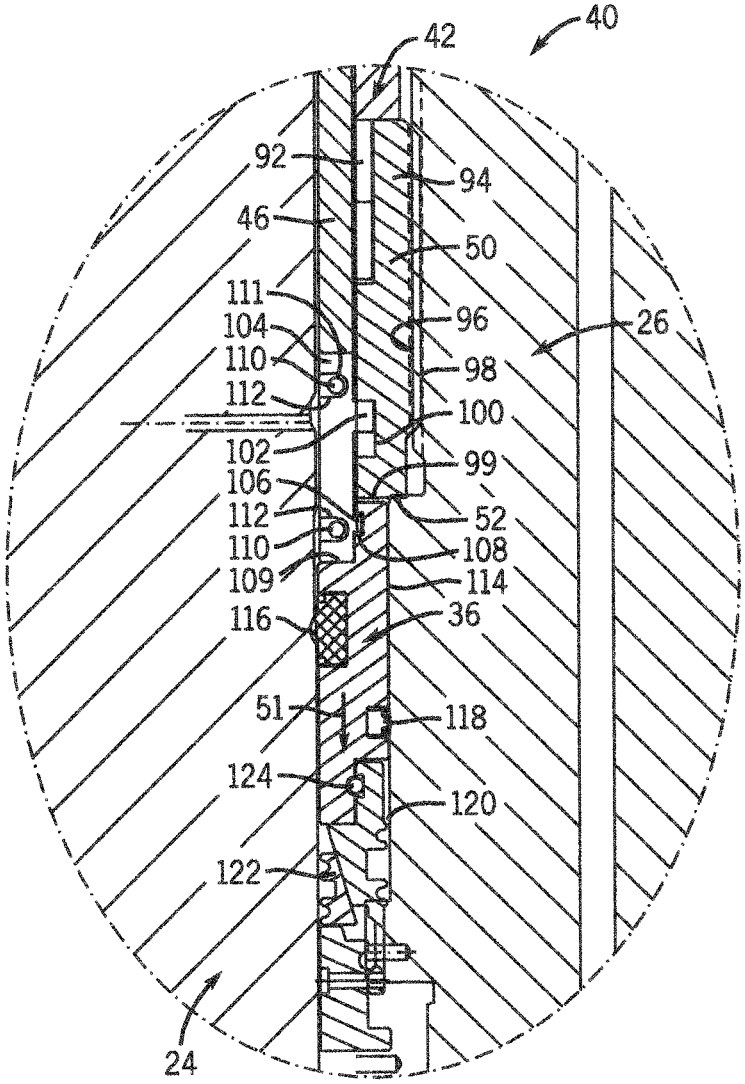
FIG. 5 illustrates a detailed view of the area 5-5 of FIG. 2.

Turning now to FIG. 5, a detail of a portion of FIG. 2, the lower portion of the setting tool 40, is illustrated. Specifically, the illustrated embodiment includes the seal 36 in the seated and locked position, wherein the retaining ring 50 is threaded into the locked position. In the illustrated embodiment, the inner body 42 includes a plurality of torque tabs 92. The torque tabs 92 include a plurality of fingers disposed at different circumferential positions at the lower end of the inner body 42, wherein the fingers axially mate (e.g., slide axially into engagement) with complementary torque tabs 94 of the retaining ring 50. As illustrated, the torque tabs 92 of the inner body 42 and the torque tabs 94 of the retaining ring 50 are mated together such that a rotational torque applied to the inner body 42 is transferred to the retaining ring 50. Accordingly, a torque applied to the inner body 42 is configured to rotate/torque the retaining ring 50.

The retaining ring 50 includes an inner thread 96 that mates with a complementary hanger thread 98 located on an outer diameter of the hanger 26. Accordingly, the retaining ring 50 may be treaded onto the hanger 36 via the rotating the retaining ring 50 about the hanger thread 98. As will be appreciated, rotation of the retaining ring 50 about the hanger thread 98 may convert the rotational torque to an axial load.

The retaining ring 50 also includes a bottom face 99. The bottom face 99 includes a surface of the retaining ring 50 that contacts an upper face of the seal 36. Accordingly, as the retaining ring 50 is threaded onto the hanger 26, the bottom face 99 contacts the seal 36, transmitting an axial load (e.g., the first or third axial load) from the retaining ring 50 to the seal 36 to compress or retains the seal 36. The axial load may be generated via a torque applied to the retaining ring 50. Further, the bottom face 99 may contact the hanger shoulder 52 as discussed previously. Contacting the hanger shoulder 52 may enable the seal 36 to be set in a proper position, and may prevent or reduce the possibility of over loading the seal 36.

Further, the retaining ring 50 includes a recess 100 that extends about the outer diameter of the retaining ring 50. The recess 100 is configured to mate with a complementary protrusion 102 in a coupler 104 of the second outer body 46. The complementary protrusion 102 may extend into the recess 100. During installation, the protrusion 102 extends axially into the recess 100 acts to couple the retaining ring 50 to the setting tool 40, and to prevent or reduce the possibility of the retaining ring 50 from becoming detached from the setting tool 40 during running of the setting tool 40 to the wellhead 12. In other words, the protrusion 102 may block the retaining ring 50 from falling our of the bottom of the setting tool 40, and thereby enabling the retaining ring 50 to be run to the wellhead 12 in a single trip, as opposed to separate trips and tools being used to run the retaining ring 50 and the setting tool 40 separately. Removal of the setting tool 40 may include shearing the protrusion 102 at the recess 100. In other words, when the retaining ring 50 is threaded onto the hanger 26, the setting tool 40 may be extracted axially through the adapter bore 32, shearing the protrusion 102, and leaving the seal 36 and the retaining ring 50 in the locked position.

The coupler 104 enables assembly of the retaining ring 50 and the seal 36 to the second outer body 46. In the illustrated embodiment, the coupler 104 is attached to the lower end of the second outer body 46 and is proximate the seal 36 and/or the retainer ring 50. The coupler 104 includes the protrusion 102 that mates with (e.g., extends axially into) the recess 100 of the retaining ring 50, and a second protrusion 106 that mates with (e.g., extends axially into) a second recess 108 of the seal 36. The second protrusion 106 includes a finger, plug, rib, or the like, that extends radially from the coupler 104. The recess 108 includes at least a portion of a recessed ring in the outer diameter of the seal 36. Mating the second protrusion 106 to the second recess 108 enables the setting tool 40 to retain the seal 36. Similar to the discussion regarding retaining ring 50, retaining the seal 36 enables the setting tool 40 to retain the seal 36 such that the setting tool 40 can run the seal 36 and the retaining ring 50 to the wellhead 12 in a single trip, as opposed to making multiple trips to run the retaining ring 50, the seal 36, and the setting tool 40. Further, when the setting tool 40 and coupler 104 are extracted through the adapter bore 32, the second protrusion 106 is axially sheared off, leaving the seal 36 and the retaining ring 50 in the locked position. It is also noted that the coupler 104 includes an engagement face 109 that contacts and transfers axial loads to the seal 36.

The coupler 104 is removable from the second outer body 46, and enables the seal 36 and the retaining ring 50 to be installed internal to the second outer body 46. In the illustrated embodiment, the coupler 104 is retained by coupler pins 110 that are inserted into a complementary hole 111 of the second outer body 46. During assembly of the setting tool 40, the retaining ring 50 and the seal 36 slide axially into the internal region of the second outer body 46, the coupler 104 moves into position such that the protrusion 102 mates with the recess 100, the second protrusion 106 mates with the second recess 108, and the coupler pins 110 assemble to the second outer body 46 to retain the coupler 104. In the illustrated embodiment, the coupler 104 includes two recesses 112 that provide a location for placement of the coupler pins 110.

The seal 36 can include various annular seals that are used to seal the annular region that exists between two concentric members. In the illustrated embodiment, the seal 36 includes a seal carrier 114, a first test seal 116, a second test seal 118, an inner seal 120, an outer seal 122, and a bearing 124. The first test seal 116 includes an elastomeric seal that is disposed in a recess about the outer diameter of the seal carrier 114. In the illustrated embodiment, the first test seal 116 includes an S-seal. The first test seal 116 provides a seal between the seal carrier 114 and the internal diameter of the tubing spool bore 34. The second test seal 118 includes an electrometric seal that is disposed in a recess about the internal diameter of the seal carrier 114. In the illustrated embodiment, the second test seal 118 includes an S-seal. The second test seal 118 provides a seal between the seal carrier 114 and the outer diameter of the hanger 26.

The inner seal 120 and the outer seal 122 include components of a CANH seal that is manufactured by Cameron of Houston, Tex. As illustrated, the inner seal 120 and the outer seal 122 share an angled interface. The angled interface enables an axial force exerted on the inner seal 120 to cause the inner seal 120 and the outer seal 122 to be displaced in opposite radial directions. For instance, an axial force in the direction of arrow 51 (e.g., the first, and third axial loads) may cause the seal 36 to deform or maintain a position that includes the inner seal 120 contacting and sealing against an outer diameter of the hanger 26, and the outer seal 122 contacting and sealing against an inner diameter of the tubing hanger bore 34. Further, a seal is created at the angled interface between the inner seal 120 and the outer seal 122. Accordingly, the seal 36 may provide an effective fluid seal across the annular region between the inner concentric member (e.g., the hanger 26) and the outer concentric member (e.g., the tubing spool 24).

It is noted that the illustrated embodiment includes the bearings 124 disposed between the seal carrier 114 and the inner seal 120. The bearings reduce the friction between the inner seal 120 and the seal carrier 114 such that a torque or rotation of one of the components may not transfer a torque to the other. For example, the bearings may prevent or reduce the possibility of the inner seal 120 from rotating as a result of the retaining ring 50 being rotated/torqued onto the hanger 26.

Figure 6:
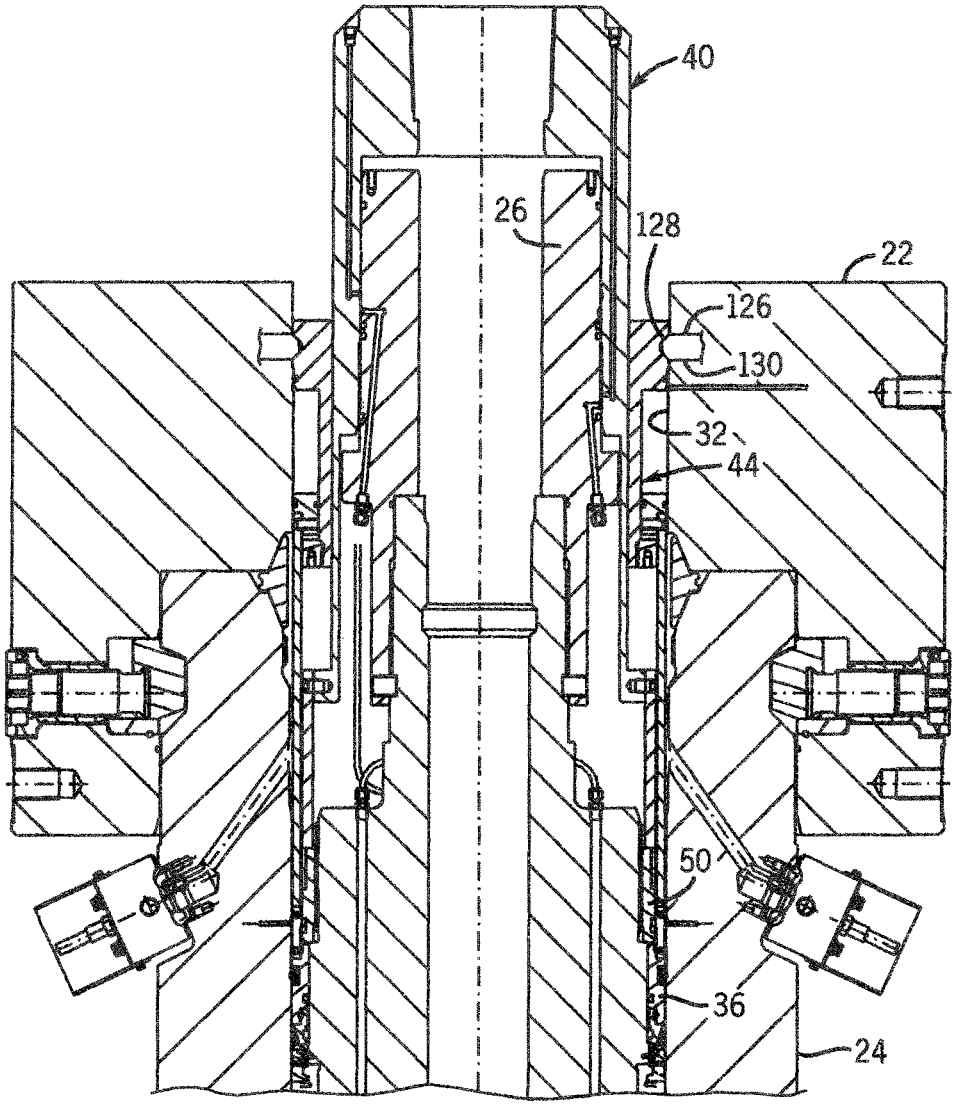
FIG. 6 illustrates an embodiment of an annular seal setting tool, an annular seal, and a tubing hanger, disposed in a wellhead of the mineral extraction system of FIG. 1.

Turning now to FIG. 6, another embodiment of the adapter 22 is illustrated. Specifically, the adapter 22 includes pins 126 that retain the setting tool 40, as opposed to the hydraulically actuated lock ring 54 that was previously discussed with regard to FIGS. 2-4. The pins 126 include one or more members that can be extended from the adapter 22 into the adapter bore 32 to engage a complementary locking groove 128 of the setting tool 40. For example, in the illustrated embodiment, the pins 126 include threaded fasteners that are threaded into pin holes 130 extending though the adapter 22 and into the adapter bore 32, and that engage the locking groove 128 in an outer diameter of the first outer body 44 of the setting tool 40. The pins 126 may include a hex head set screw that is manually advanced via rotation of the fastener, for example. The pins 126 may be spring loaded to promote engagement. Such an embodiment may also include the other features of the setting tool 40, seal 36, and retaining ring 50, as discussed previously.

Figure 7:
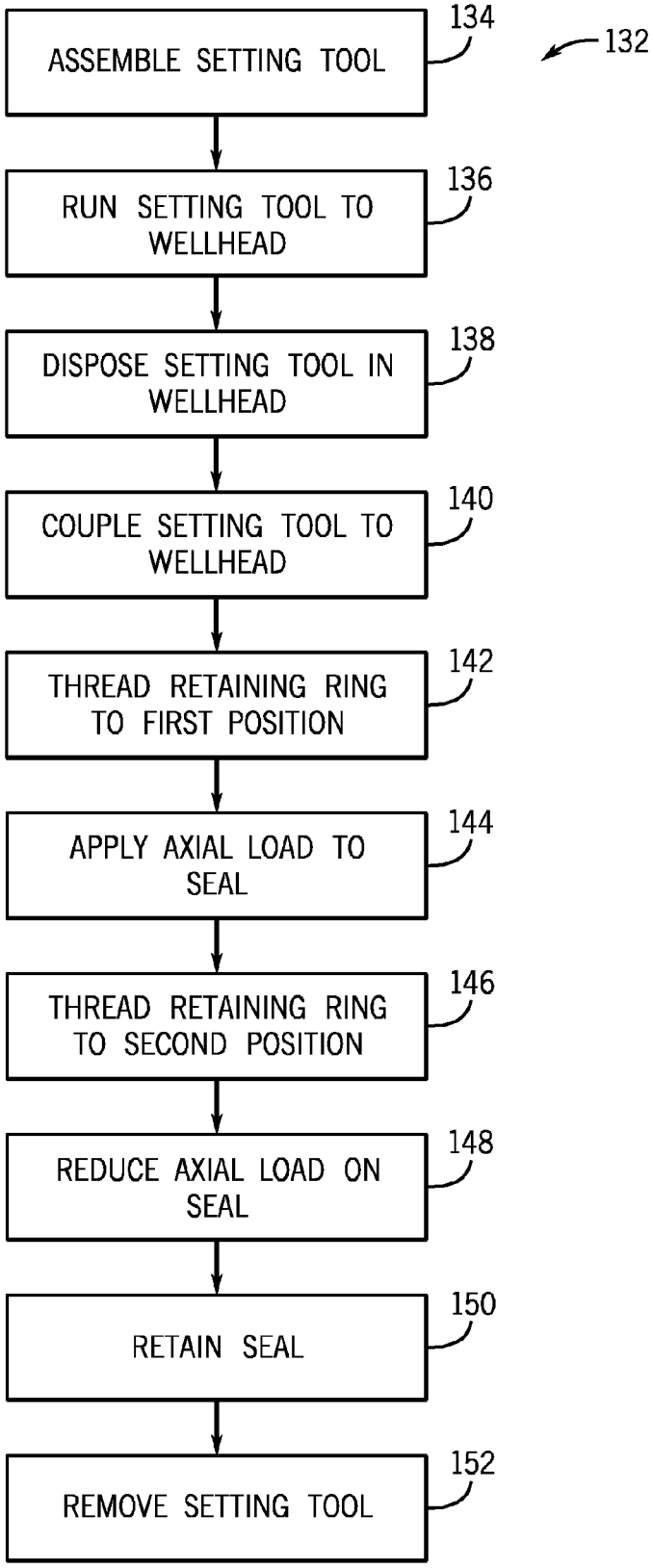
FIG. 7 illustrates a flowchart of an exemplary method of operation of the mineral extraction system of FIG. 1.

In operation, previously discussed embodiments of the setting tool 40 may be employed to deliver, seat, and lock the seal 36 in the annular region between the tubing spool 24 and the hanger 26. For example, FIG. 7 is a flowchart that illustrates a method 132 of installing the seal 36 in accordance with previously discussed embodiments. The method 132 includes assembling the setting tool 40, as depicted at block 134. In one embodiment, assembling the setting tool 40 includes affixing the retaining ring 50 and the seal 36 to the second outer body 46 via the coupler 104. The assembled setting tool 40 is run to the wellhead 12, as illustrated at block 136, and is disposed internal to the wellhead 12, as illustrated at block 138. Specifically, the setting tool 40 is lowered into the adapter bore 32 and the tubing spool bore 34 such that the seal 36 is disposed in the annular region between the tubing spool 24 and the hanger 26. As the setting tool 40 is lowered into the wellhead 12, the retaining ring 50 may engage the top of the hanger thread 98.

The method 132 also includes mechanically coupling to the setting tool 40 to the wellhead 12, as illustrated at block 140. Mechanically coupling may include one or more techniques based on the mechanism employed to couple the setting tool 40 to the wellhead 12. For example, if the locking mechanism includes the lock ring 54, as illustrated in FIGS. 2-4, mechanically coupling includes injecting a hydraulic fluid into the locking cavity 70 via the locking port 69 of the adapter 22 and the locking port 68 of the locking sleeve 56. Injection of the pressurized hydraulic fluid urges the locking sleeve 56 to move radially into engagement with the lock ring 54, and, in turn, urges the lock ring 54 to move radially into engagement with the complementary locking groove 58 of the adapter 22. If the locking mechanism includes the pins 126, as illustrated in FIG. 6, mechanically coupling includes advancing the pins 126 of the adapter 22 into engagement with the complementary groove 128 in the first outer body 44 of the setting tool 40.

The method 132 also includes threading the retaining ring 50 into a first position, as illustrated at block 142. For example, the rotating the retaining ring 50 includes threading the retaining ring 50 onto the hanger thread 98. Rotation of the retaining ring 50 is accomplished by rotating the inner body 42. The torque generated by rotating the inner body 42 is transferred to the retaining ring 50 via the torque tabs 92 and 94. In one embodiment, the retaining ring 50 may be threaded onto the hanger thread 98 such that it does not contact the seal 36, or that it generates no significant axial load on the seal 36. In another embodiment, the retaining ring 50 is threaded into the first position, such that it exerts the first axial load on the seal 36 that advances the seal 36 into a first position.

The method 132 includes applying an axial load to the seal 36, as illustrated at block 144. In one embodiment, the second outer body 46 is axially advanced to apply the second axial load on the seal 36. For example, hydraulic fluid is injected into the loading cavity 48 to generate the second axial load on the second outer body 46 that, in turn, advances the seal 36 axially into a second position. Urging the seal 36 in the second position may reduce the axial loading at the interface between the retaining ring 50 and the seal carrier 114. The second axial load is controlled by injecting and pressurizing the hydraulic fluid via the loading port 89.

The method 132 includes threading the retaining ring 50 to a second position, as illustrated at block 146. In one embodiment, the retaining ring 50 is again rotated into a locking position to retain the seal 36. For example, with the friction between the retaining ring 50 and the seal carrier 114 reduced by the second axial load, the retaining ring 50 is threaded onto the hanger 36 until the retaining ring 50 is in a desired (e.g., locked) position. Rotation of the retaining ring 50 is once again provided via rotating the inner body 42. The torque is transferred from the inner body 42 to the retaining ring 50 via the torque tabs 92 and 94.

The method 132 also includes reducing the axial load on the seal 36, as illustrated at block 148. In one embodiment, reducing the axial load includes reducing the hydraulic pressure in the loading cavity 48 to reduce the second axial load. In other words, the hydraulic fluid may be released or removed from the loading cavity 48 via the loading port 89 in the adapter 22. With the second axial load removed, the seal 36 may be retained in the seated and locked position by the retaining ring 50, as illustrated at block 150.

Finally, the method 132 includes removing the setting tool 40, as illustrated at block 152. In one embodiment, removing the setting tool 40 includes unlocking the setting tool 40 from the wellhead 12, followed by extracting the setting tool 40 from the wellhead 12. For example, if the locking mechanism includes the lock ring 54 (see FIG. 2-4), unlocking the setting tool 40 includes injecting a hydraulic fluid into the unlocking cavity 80 via the unlock port 78 of the adapter 22 and the unlock port 76 of the locking sleeve 56. This disengages the locking sleeve 56 from the lock ring 54, and disengages the lock ring 54 from the complementary locking groove 58 of the adapter 22. If the locking mechanism includes the pins 126 (see FIG. 6), unlocking includes disengaging (e.g., threading, pulling, removing) the pins 126 from the complementary groove 128 in the first outer body 44 of the setting tool 40.

With the setting tool 40 unlocked from the wellhead 12, the setting tool 40 is extracted along the axis of the tubing spool bore 34 and the adapter bore 32. The removal of the setting tool 40 shears the protrusion 102 and the second protrusion 106 of the coupler 104. As a result, the seal 36 and the retaining ring 50 remain fixed in the seated and locked position.

The method 132 provides for the running and installation of the seal 36 with minimal number of runs (e.g., a single trip) to the wellhead 12, and reduces the potential for damage to the seal 36. For instance, the retaining ring 50 and the seal 36 are run with the setting tool 40. Further, the second axial load enables the retaining ring 50 to be rotated without transferring a significant amount of torque (none or minimal torque) to the seal 36. The minimal transfer of torque to the seal 36 prevents or reduces the possibility of the seal from rotating, thereby reducing the possibility of wear and damage to the seal 36 and the sealing surfaces of the hanger 26 and the tubing spool bore 34. As will be appreciated, the steps of the method 132 may be modified or accomplished in a variety of orders. For example, threading the retaining ring into a first position (block 142) may be provided before the setting tool 40 is coupled to the wellhead 12 (block 140).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A tool for setting an annular seal, comprising:

an inner body, wherein the inner body is configured to rotate about a longitudinal axis of the tool and is configured to bias a retaining ring along the longitudinal axis;

a first outer body coaxial with the longitudinal axis and configured to couple to an adapter of a mineral resource system; and a second outer body coaxial with the longitudinal axis, wherein the second outer body is coupled to the first outer body, and the second outer body is configured to move along the longitudinal axis in response to fluid pressure in an outer load cavity defined between the first outer body, the second outer body, and the adapter to bias the annular seal.

2. The setting tool of claim 1, comprising a locking mechanism configured to couple the tool to a wellhead by fixing the first outer body relative to the adapter.

3. The setting tool of claim 2, wherein the locking mechanism comprises a lock ring configured to engage a complementary groove of the adapter.

4. The setting tool of claim 2, wherein the locking mechanism comprises locking pins.

5. The setting tool of claim 1, wherein the inner body comprises fingers disposed at different circumferential positions of the inner body and configured to mate with complementary fingers disposed at different circumferential positions of the retaining ring, wherein the fingers facilitate biasing of the retaining ring along the longitudinal axis upon rotation of the inner body about the longitudinal axis.

6. The setting tool of claim 1, wherein the inner body is configured to rotate relative to the first outer body and the second outer body to thread the retaining ring onto a tubular.

7. The setting tool of claim 1, wherein the tool is configured to urge the retaining ring into a locked position, wherein the retaining ring is configured to retain the annular seal in the locked position.

8. The setting tool of claim 1, wherein the first outer body and the second outer body are configured to slide axially relative to one another.

9. The setting tool of claim 1, wherein the second outer body is configured to bias the annular seal into compression to reduce a load between the retaining ring and the annular seal.

10. A method for setting an annular seal, comprising:

rotating an inner body of a tool about a longitudinal axis of the tool to bias a retaining ring along the longitudinal axis, wherein the tool comprises first and second outer bodies coupled to one another and coaxial with the longitudinal axis, the first outer body is configured to couple to an adapter of a mineral resource system; and moving the second outer body along the longitudinal axis in response to fluid pressure in an outer load cavity defined between the first outer body, the second outer body, and the adapter to bias the annular seal.

11. The method of claim 10, comprising coupling the tool to a wellhead via a locking mechanism that fixes the first outer body relative to the adapter.

12. The method of claim 11, comprising engaging a lock ring of the locking mechanism with a complementary groove of the adapter.

13. The method of claim 11, wherein the locking mechanism comprises locking pins.

14. The method of claim 10, comprising mating fingers at different circumferential positions of the inner body with complementary fingers at different circumferential positions of the retaining ring, wherein the fingers facilitate the biasing of the retaining ring along the longitudinal axis upon rotation of the inner body about the longitudinal axis.

15. The method of claim 10, comprising rotating the inner body relative to the first outer body and the second outer body to thread the retaining ring onto a tubular.

16. The method of claim 10, comprising urging the retaining ring into a locked position via the tool.

17. The method of claim 16, comprising retaining the annular seal in the locked position via the retaining ring.

18. The method of claim 10, comprising axially sliding the first and second outer bodies relative to one another.

19. The method of claim 10, comprising biasing, via the second outer body, the annular seal into compression to reduce a load between the retaining ring and the annular seal.

20. The method of claim 10, comprising threading the retaining ring into a first position prior to applying an axial load on the annular seal.

* * * * *